United States Patent [19]

Schonasky

[11] 4,431,151

[45] Feb. 14, 1984

[54] FIXTURE SUPPORTING CLIP

[75] Inventor: William R. Schonasky, 7300 Byrnsley La., Annandale, Va. 22003

[73] Assignees: Robert L. Fournier, Arlington, Va.; Carolyn L. Wade, Washington, D.C.; William R. Schonasky, Annandale, Va. ; a part interest

[21] Appl. No.: 285,443

[22] Filed: Jul. 21, 1981

[51] Int. Cl.[3] ..... G12B 9/00

[52] U.S. Cl. ..... 248/27.1; 248/342

[58] Field of Search ..... 248/27.1, 27.3, DIG. 6, 248/342, 343, 344; 52/39, 28; 174/58, 61; 220/3.5, 3.9

[56] References Cited

U.S. PATENT DOCUMENTS

| | | | |
|---|---|---|---|
| 2,340,823 | 2/1944 | Scott | 248/DIG. 6 |
| 2,762,591 | 9/1956 | Weber | 248/DIG. 6 |
| 2,898,075 | 8/1959 | McGinty | 248/343 |
| 2,930,505 | 3/1960 | Meyer | 248/27.1 X |
| 3,268,189 | 8/1966 | Ducharme | 248/27.1 |

FOREIGN PATENT DOCUMENTS

| | | | |
|---|---|---|---|
| 272586 | 9/1970 | U.S.S.R. | 248/27.3 |

*Primary Examiner*—J. Franklin Foss
*Attorney, Agent, or Firm*—A. W. Breiner

[57] ABSTRACT

A fixture supporting clip for mounting a recessed light fixture in a ceiling panel is disclosed. The clip includes a supporting leg and a clamping leg connected by a hinge. A retaining flange extends from each of the supporting leg and clamping leg. A light fixture can be mounted in a ceiling panel by passing a fastener, such as a metal screw, through a wall of the fixture and into the supporting clip so as to draw the supporting leg and clamping leg together to hold the fixture secure.

7 Claims, 5 Drawing Figures

FIXTURE SUPPORTING CLIP

This invention relates in general to new and useful improvements in mounting clips, and more particularly to a fixture supporting clip for supporting a fixture within an opening in a panel. Most particularly, the fixture supporting clip is intended to be utilized in mounting a recessed lighting fixture within an opening in a ceiling panel.

Numerous attempts have been made in the past to provide a simple mounting clip wherein a lighting fixture may be mounted in a recessed relation within a ceiling panel. A major difficulty in mounting the lighting fixture within an opening in a ceiling panel is the non-availability of space for mounting means. As a result, the mounting of the lighting fixture is quite difficult.

Attention is directed to the patent to Anthony E. Zingone, U.S. Pat. No. 2,744,716, granted May 8, 1955, wherein there are illustrated means for mounting a lighting fixture. It will be seen that in accordance with the Zingone patent, the lighting fixture is provided with flanges which must engage the underside of the ceiling panel, and is further provided with jack supports which are carried by the side walls of the lighting fixture and are forced downwardly to engage the upper side of the ceiling panel and to draw the retaining flanges up against the underside of the ceiling flange. It will be seen that the jack supports of the Zingone device must be built into the lighting fixture and cannot be used in conjunction with lighting fixtures of general construction.

In accordance with this invention, it is proposed to provide a fixture mounting clip which may be readily positioned at opposite sides of an opening in a panel. The clips will retain their position on the panel whereby a lighting fixture may be positioned between the clips; and, after the lighting fixture is positioned within the opening, it may be readily assembled with the clips and the clips activated so as to clamp onto the ceiling panel.

More particularly, there is provided a simple clip which is of a one-piece sheet metal construction and wherein the sheet metal is folded to define a clamping leg joined to a supporting leg by an integral bight portion and wherein the clamping leg carries at a lower edge a clamping flange which is co-operable with a retaining flange carried at the lower edge of the supporting leg. Initially, the clamping leg is disposed in diverging relation with respect to the supporting leg, and the clamping flange is widely spaced from the retaining flange so that the clip may be readily assembled with respect to a panel.

The clip is provided with a pair of elongated openings in the supporting leg for receiving fasteners, and associated with each opening in the supporting leg is a plurality of apertures in the clamping leg which will receive, in threaded engagement, a threaded fastener. This arrangement permits ease of alignment of openings in walls of the lighting fixture with the clip. When a fastener is passed through a wall of the lighting fixture, the supporting leg, and threaded into one of the apertures in the clamping leg, and that fastener is tightened up, the clamping leg is drawn towards the support leg and draws the clamping flange down towards the retaining flange to clamp therebetween the panel, while at the same time the supporting leg is drawn against the wall of the lighting fixture. Thus, the mounting of the lighting fixture requires but a very simple operation.

Having described the invention is general terms, specific and presently preferred embodiments will be set forth in the context of the illustrative drawing.

Figure 4:
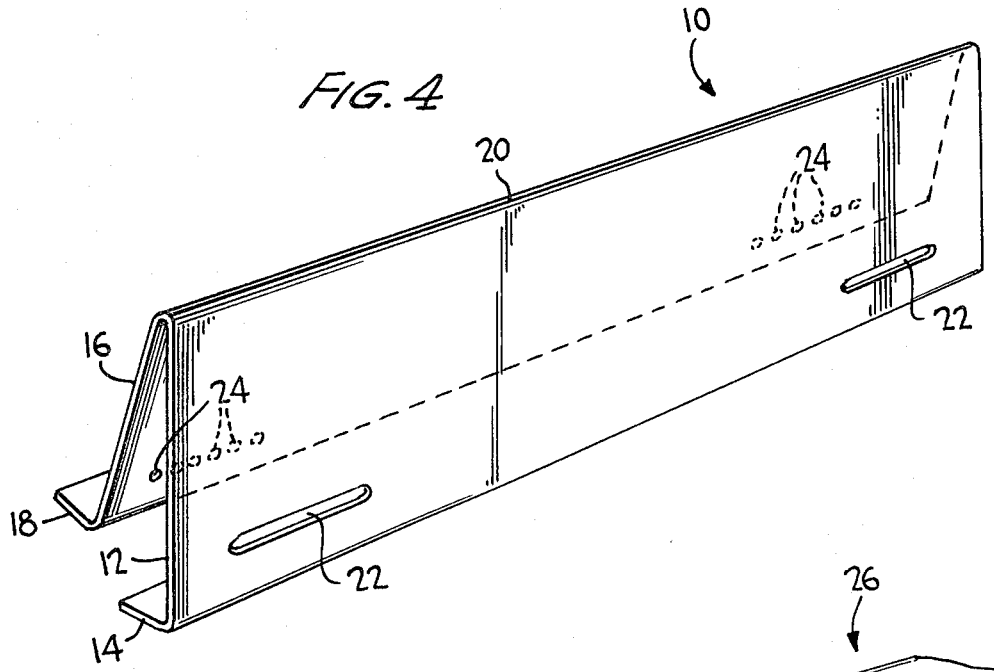
FIG. 4 is a perspective view of one of the fixture supporting clips.

Referring now to the drawings in detail, reference is first made to FIG. 4 wherein there is illustrated a fixture supporting clip formed in accordance with this invention, the fixture supporting clip being generally identified by the numeral 10. The fixture supporting clip 10 includes a supporting leg 12 which is provided at the lower end thereof with a retaining flange 14. The clip 10 also includes a clamping leg 16 which is provided at the lower end thereof with a clamping flange 18. It will be seen that the retaining flange 14 extends generally towards the clamping leg 16, and that the retaining flange 14 and the clamping flange 18 extend in the same general direction.

The upper end of the clamping leg 16 is connected to the upper end of the supporting leg 12 by hinge means 20. In the preferred embodiment of the invention, the clip 10 is formed of one piece of sheet metal and the hinge means 20 is an integral bight portion. However, it is feasible that the clamping leg 16 be formed separately of the supporting leg 12, and that an actual hinge construction be provided to connect together the clamping leg and the supporting leg.

It is to be noted that the supporting leg 12 has two elongated openings or slots 22 formed therein. The openings 22 are preferably elongated in the general direction of the retaining flange 14.

The clamping leg 16 has formed therein a plurality of apertures 24 which are generally arranged in a line an alignment with a respective opening 22. By providing a plurality of the apertures 24, it is not necessary that a mounting opening or hole be formed in a fixture which is to be mounted which must be in accurate alignment with an opening in the supporting clip 10. With respect to the apertures 24, it is to be understood that they are of a diameter so as to receive in threaded engagement a threaded fastener, generally a sheet metal type fastener.

Figure 3:
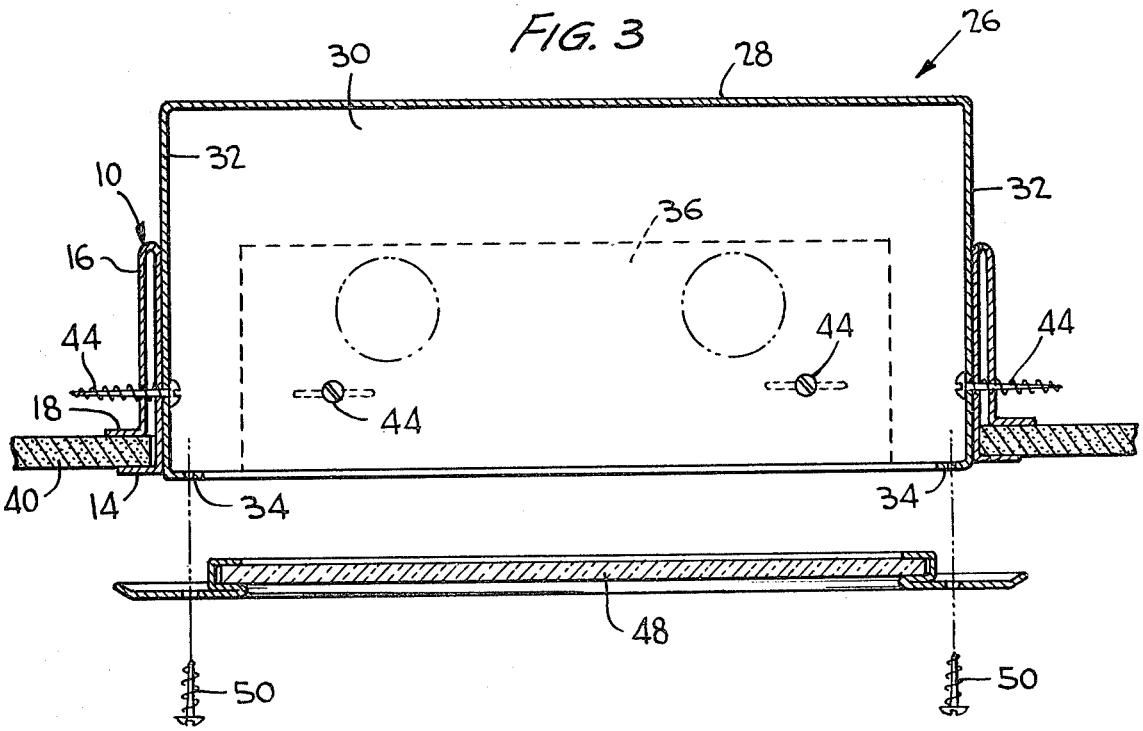
FIG. 3 is an enlarged, exploded sectional view taken generally along the line 3—3 of FIG. 1 and shows a lighting fixture mounted within a ceiling opening ready to receive the usual diffusor panel.
Figure 5:
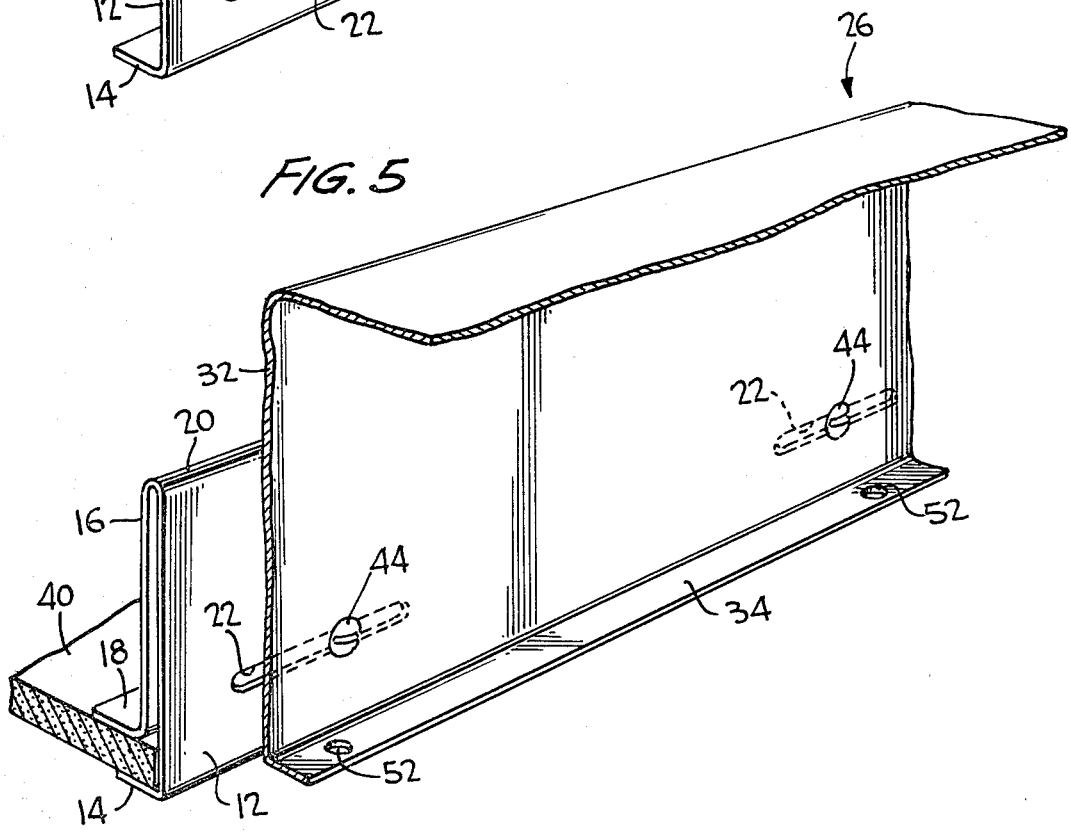
FIG. 5 is an enlarged, fragmentary perspective view showing the specific relationship between the fixture supporting clip, a wall of the lighting fixture, and a ceiling panel.

Reference is now made to FIGS. 3 and 5 wherein there is illustrated the box 26 of a typical lighting fixture. The box 26 has a top wall 28, a pair of end walls 30, and a pair of side walls 32. At least the side walls 32 and preferably also the end walls 30 are provided at their lower ends with mounting flanges 34 for a purpose to be described in detail hereinafter.

Figure 1:
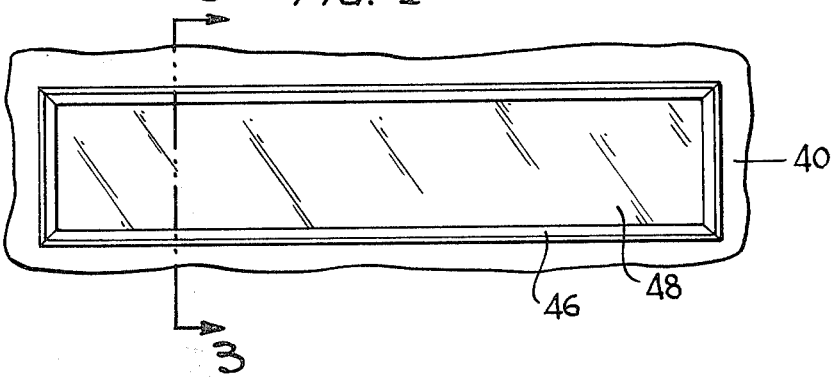
FIG. 1 is a bottom view of a ceiling having mounted therein a lighting fixture in accordance with the invention.
Figure 2:
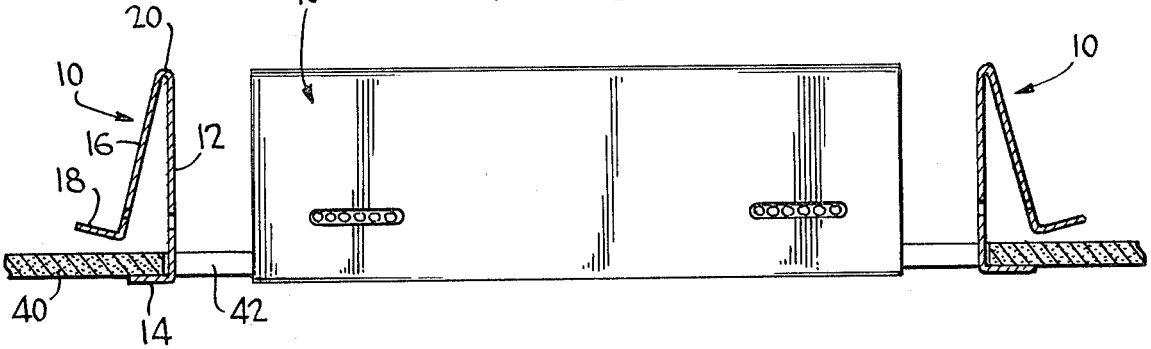
FIG. 2 is a vertical sectional view taken through a ceiling having an opening therein in which a lighting fixture is to be mounted in recessed relation and shows fixture supporting clips in accordance with this invention mounted in place along opposite sides of the opening.

Referring now to FIG. 2, it will be seen that there is illustrated a ceiling panel 40 having an opening 42 formed therein for receiving the light box 26. In accordance with this invention, one of the clips 10 will be mounted at each end of the opening 42 and along each side thereof. Three of such clips are illustrated in FIG. 2.

With reference to the clip 20 at the left of FIG. 2, it will be seen that the initial position of the clamping flange 18 relative to the retaining flange 14 is such that the clip may be readily positioned over an edge of the ceiling panel 40. Then, the clamping legs 16 may be bent slightly towards the supporting leg 12 so as to bring the clamping flange 18 into initial contact with the upper surface of the ceiling panel 40, as shown at the right of FIG. 2. The clip is now in a self-sustaining position relative to the ceiling panel 40, and the four clips are now ready to receive the light box 26.

It is to be understood that the walls 30, 32 of the light box 26 will have drilled therein suitable openings which are at the proper height for the proper mounting of the light box 26, and are generally aligned there with the openings 22 in the respective clips 10. Accordingly, all that is necessary is to move the light box 26 up between the supporting legs 12 of the clips 10 until it is at the proper vertical elevation, after which threaded fasteners 44 are passed through the openings in the walls of the light box, then through a respective opening 22 in the adjacent supporting leg 12, and finally into one of the aligned apertures 24 in the clamping leg 16. The threaded fastener 44 is normally of the sheet metal type and is self-tapping into the aperture 24. Once all of the fasteners 44 have been loosely positioned, it is merely necessary to exert a light upward pressure on the light box 26 and then to screw the threaded fasteners 44 into tightened positions. As each fastener 44 is drawn tight, it will swing the associated clamping leg 16 towards the supporting leg 12, with the result that the associated clamping flange 18 moves towards the supporting leg 12 and down towards the retaining flange 14 to tightly clamp the ceiling panel 40 between the clamping leg 18 and the retaining leg 14. Further, as the threaded fastener is drawn tight, it will tightly draw the clip 10 towards the light box 26 with the supporting leg 12 being flush and tight against the associated wall 30, 32. The mounting of the light box 26 is now complete; and all that is necessary after the required electrical connection is made is to secure the mounting frame 46 of a diffusor panel 48 against the underside of the ceiling 40 by means of threaded fasteners 50 which pass through the frame 46 and are threadedly engaged in apertures 52 formed in the respective mounting flange 34, which apertures are illustrated in FIG. 5.

It will be readily apparent from the foregoing that the fixture supporting clips 10 are of a very simple construction and can be readily made at a very low cost. Further, the fixture supporting clips 10 are easily assembled with the panel in which a recessed fixture is to be mounted and will remain in position while the fixture is inserted within an opening in the panel, after which the securement of the fixture to the clips requires only the passing of the threaded fasteners 44 through the automatically aligned openings and the threading of the fasteners into place to simultaneously actuate the clips 10 to clamp the panel and to secure the clips 10 to the walls of the fixture.

Although this invention particularly relates to the mounting of light fixtures within a ceiling, it is to be understood that the invention is not so limited to the mounting of light fixtures, but that the clips 10 may be utilized in the mounting of fixtures of various types.

Although only a preferred embodiment of clip has been specifically illustrated and described, it is to be understood that minor variations may be made in the structure of the fixture supporting clip without departing from the spirit and scope of the invention as defined by the appended claims.

It is claimed:

1. A fixture supporting clip comprising a supporting leg and a clamping leg, a retaining flange extending from one end of said supporting leg and extending generally in the direction of said clamping leg, a clamping flange co-operable with said retaining flange, said clamping flange extending from an end of said clamping leg adjacent to said retaining flange and extending in the same general direction as said retaining flange, and hinge means hingedly connecting the other end of said supporting leg and said clamping leg for relative pivotal movement, said clamping leg extending away from said supporting leg at an angle and being movable to a position generally parallel to said supporting leg wherein said flanges are in generally parallel clamping relation, said supporting leg having an elongated opening for freely passing a fastener, and said clamping leg having aperture means generally aligned with said elongated opening and of a smaller size for receiving and holding a fastener over substantially the entire length of said elongated opening.

2. A fixture supporting clip according to claim 1 wherein said clip is formed in one piece of sheet metal, and said hinge means in an integral bight portion.

3. A fixture assembly particularly adapted for recessed mounting in an opening in a panel, said fixture assembly comprising a fixture having at least two opposite walls, a supporting clip carried by each of said opposite walls and fastener means for securing each clip to said fixture and in said panel, each of said clips including a supporting leg carrying a retaining flange at one end thereof for engaging the exterior of a panel with said fastener securing said supporting leg against a respective one of said walls, a clamping leg carrying a clamping flange at the end therefor for engaging the interior of a panel in cooperation with said retaining flange, hinge means for hingedly connecting together the other end of said support leg and said clamping leg remote from said one end, said clamping leg diverging from said supporting leg and being more widely spaced from said retaining flange than the thickness of the intended panel, with said fastener means drawing said clamping leg towards said supporting leg with said clamping flange moving toward said retaining flange and toward a panel clamping position.

4. A fixture assembly according to claim 3 wherein said fixture is a light fixture and said panel is a ceiling panel.

5. A fixture assembly according to claim 3 wherein each said clip is of a one-piece sheet metal construction, and said hinge means is a bight portion joining together said supporting leg and said clamping leg.

6. A fixture assembly according to claim 3 wherein said supporting leg has for each of said fasteners an opening freely passing through said fastener, and said clamping leg has an aperture generally aligned with said opening for receiving said fastener in threaded engagement.

7. A fixture assembly according to claim 6 wherein said opening in said supporting leg is elongated and there are a plurality of said apertures arranged in a line in said clamping flange whereby alignment of one of said apertures with an opening in said fixture is assured.

* * * * *